US005283010A

United States Patent [19]

Waring

[11] Patent Number: 5,283,010

[45] Date of Patent: Feb. 1, 1994

[54] TRITIUM REMOVAL

[75] Inventor: Stephen Waring, Wantage, United Kingdom

[73] Assignee: United Kingdom Atomic Energy Authority, London, England

[21] Appl. No.: 665,577

[22] Filed: Mar. 6, 1991

[30] Foreign Application Priority Data

Mar. 14, 1990 [GB] United Kingdom ..... 9005707

[51] Int. Cl.[5] ..... G21F 9/00

[52] U.S. Cl. ..... 252/626; 252/632; 204/157.15; 376/309; 376/310; 376/313; 376/314; 976/DIG. 381

[58] Field of Search ..... 204/157.43, 157.15; 252/626, 632; 976/DIG. 381; 376/309, 310, 313, 314; 422/159, 186.05

[56] References Cited

U.S. PATENT DOCUMENTS 4,223,448 9/1980 Saito et al. ..... 34/4
4,338,102 7/1982 Otsuka et al. ..... 55/185
4,565,670 1/1986 Miyazaki et al. ..... 422/186.04
4,727,231 2/1988 Hayano et al. ..... 219/10.55 R
4,844,838 7/1989 Ohtsuka et al. ..... 252/629
4,882,093 11/1989 Giroux et al. ..... 252/632
4,964,900 10/1990 Thompson et al. ..... 55/387

OTHER PUBLICATIONS

H. Yasunaka et al, "Microwave Decontaminator for Concrete Surface Decontamination in JPDR," 1987 International Decommissioning Symposium, Oct. 4-8, 1987, pp. IV-109-IV-116.

*Primary Examiner*—Donald P. Walsh
*Assistant Examiner*—Ngoclan T. Mai
*Attorney, Agent, or Firm*—William R. Hinds

[57] ABSTRACT

Where a concrete structure (12) has been contaminated with tritium (whether as gas or as water) the tritium atoms take the place of ordinary hydrogen atoms in water and in hydroxyl groups in the concrete, rendering it radioactive. The degree of contamination may be reduced by irradiating the surface with microwaves to vaporize water, while extracting water vapor from the surface region through a dust filter (28) and a water trap (30). This can considerably reduce the radioactivity, and hence the cost of disposal of the concrete.

5 Claims, 1 Drawing Sheet

TRITIUM REMOVAL

This invention relates to a method and for removing tritium from an object.

Tritium is a radioactive isotope of hydrogen. It behaves very like ordinary hydrogen chemically, and in particular it can take the place of ordinary hydrogen in hydroxides and in water. Where an object has been contaminated with tritium-containing water then the object will consequently be radioactive; for example a concrete wall or floor might become radioactive in this way. Subsequent disposal (possibly after demolition) of the object is more expensive if it must be classified as very low level waste (VLLW, i.e. not more than 400 kBq/tonne) rather than inactive waste; it is even more expensive if it must be classified as low level waste (LLW, i.e. between 400 kBq and 12 GBq/tonne); and is still more expensive if it must be classified as intermediate level waste (ILW, i.e. above 12 GBq/tonne).

According to the present invention there is provided a method of removing tritium from a porous solid object comprising concrete, the method comprising irradiating a surface of the concrete object with microwaves of sufficient intensity to vaporize substantially all the water within about 100 mm of the surface, removing water vapor from the surface through an extraction duct incorporating a dust trap, and trapping any water vapor flowing through the duct, the irradiation intensity being such as to vaporize water and to enable it to be removed while not causing cracking or shattering of the concrete.

There is also provided an apparatus for removing tritium from an object comprising a source of microwaves, a waveguide for transmitting microwaves from the source to be incident on a surface of the object, an extraction duct for removing water vapor from the surface, and a water trap to trap any water vapor flowing through the duct.

The invention also provides a method for reducing the radioactivity of an object contaminated by tritium or by tritiated water.

Preferably the waveguide through which the microwaves are transmitted to the surface forms a part of the extraction duct. The open end of the extraction duct adjacent to the surface of the object may be surrounded by means to absorb microwaves, so in use the microwaves incident on the surface are principally absorbed in the object. The extraction duct desirably includes particle removing means, such as a cyclone or a filter, to remove solid particulate matter from the stream of gases along the duct before the stream reaches the water trap. The trap might be a cold trap, or might be a suitable molecular sieve trap. Desirably the open end of the extraction duct is provided with means to seal it to the surface, and the duct incorporates extractor means to extract gases from the part of the duct near the surface and so to maintain that part of the duct at a pressure less than that of the surroundings.

The method is particularly suitable for removing tritium from porous structural materials such as concrete, as the microwaves penetrate several centimetres below the surface, while typically the bulk of the contamination is to be found within about ten centimetres of the surface. Different depths of penetration can be achieved by a suitable choice of the frequency of the microwaves.

BRIEF DESCRIPTION OF THE DRAWINGS

The invention will now be further described by way of example only and with reference to the accompanying drawings, in which:

Referring to FIG. 1, an apparatus 10 is shown for removing tritium from a contaminated concrete wall 12. An open-ended rectangular steel-walled chamber 14 is held adjacent to a surface of the wall 12, and has a sealing gasket 16 around its open end. Just above the gasket 16 is a wire mesh sheet 18, which is attached around the outside of the chamber 14 and extends over a rectangular area of the surface of the wall 12. A rectangular metal waveguide 20 protrudes through the top wall of the chamber 14 so as to extend at 45° to the surface of the wall 12; the waveguide 20 has an open end 21 within the chamber 14 about 50 mm from the wall 12, the end 21 being perpendicular to the longitudinal axis of the waveguide 20. The other end of the waveguide 20 communicates with a source 22 of microwaves, shown diagrammatically, and described in greater detail later in relation to FIG. 2.

Figure 1:
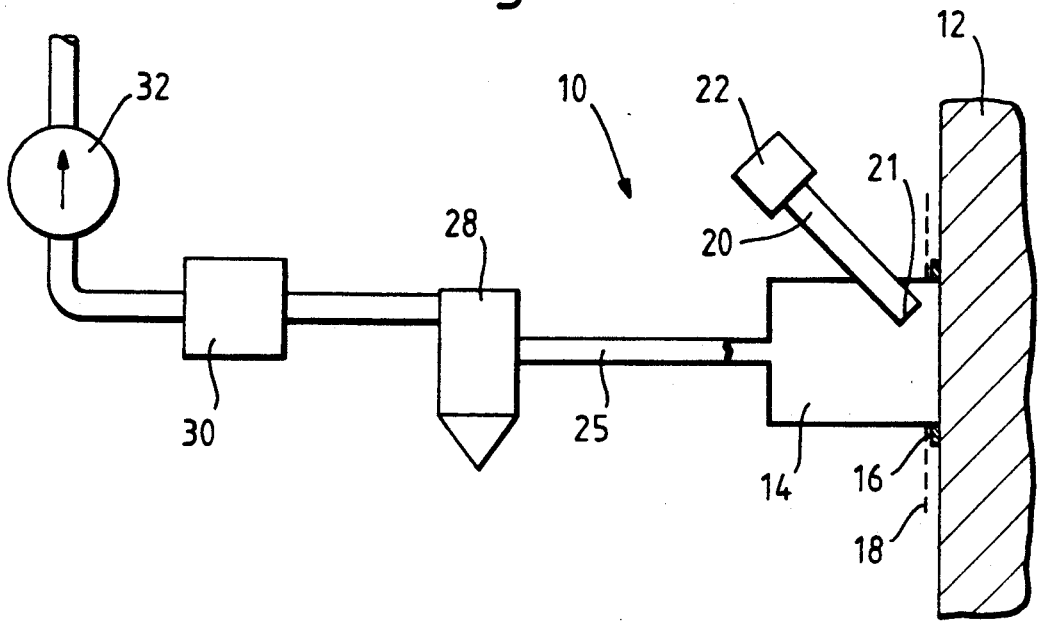
FIG. 1 shows a diagrammatic view of an apparatus for reducing the radioactivity of a concrete wall contaminated by tritium.

An extract duct 25 communicates with the chamber 14, and leads through a pulse-cleanable high efficiency particulate in air (HEPA) filter 28 and a water trap 30 to an air extractor pump 32. The water trap 30 includes a packed bed of synthetic zeolite pellets which absorb any water vapor flowing along the duct 25.

Figure 2:
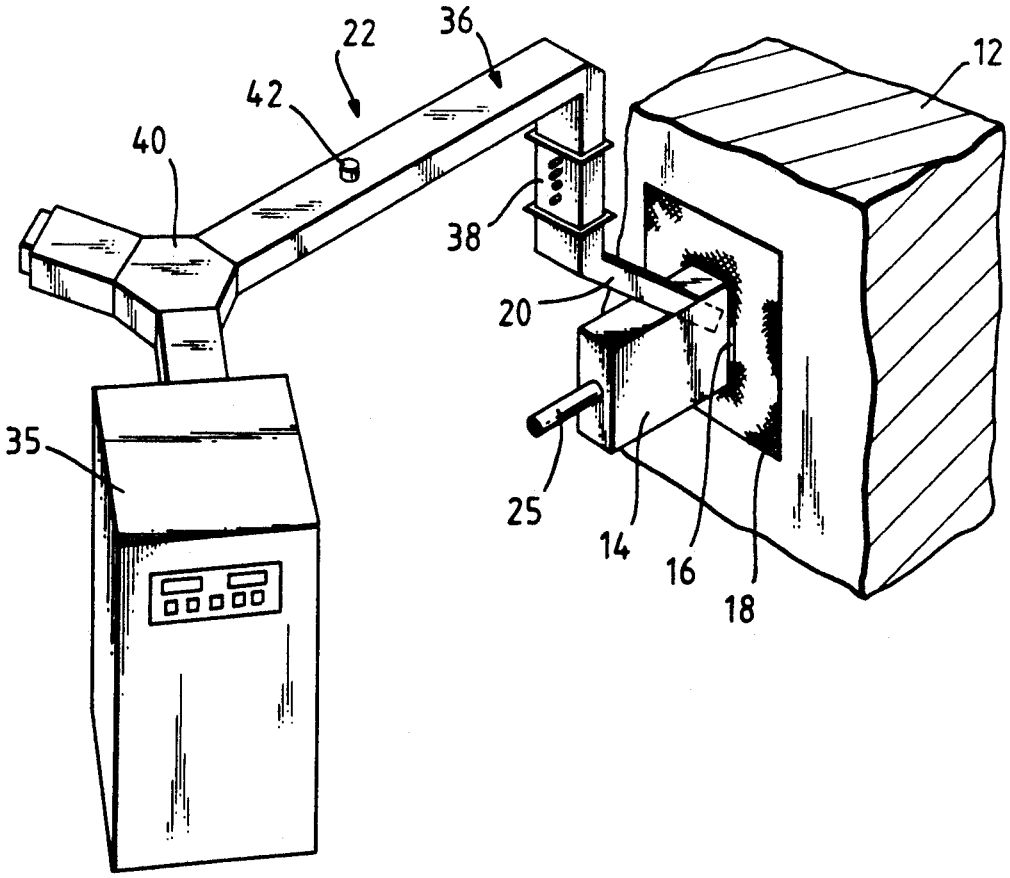
FIG. 2 shows in greater detail a perspective view of the microwave system of FIG. 1.

Referring to FIG. 2, the microwave source 22 includes a variable power 25 kW, 896 MHz microwave generator 35 which transmits microwaves into a 248 mm by 124 mm rectangular metal waveguide 36 which is about 3.5 m long in total, the end portion of which is the waveguide 20. The waveguide 36 incorporates bends so the portion 20 is downwardly inclined at 45° to the surface of the concrete wall 12, and the length of the waveguide 36 is such that the overall load impedance matches that of the generator 35. A four-stub tuning section 38 near the end portion 20 provides more precise impedance matching. A water-cooled circulator 40 protects the generator 35 from microwaves reflected back along the waveguide 36. The waveguide 36 is also provided with an air inlet 42 so it can be continuously purged of dust.

The apparatus 10 shown in FIGS. 1 and 2 may be mounted on a trolley (not shown) including a jack (not shown) so the chamber 14 can be scanned over the surface of the wall 12 by moving the trolley to and fro, and by raising or lowering the jack.

In operation, the extractor pump 32 is energised, so extracting air from the chamber 14 and causing a steady air flow along the waveguide 36 from the air inlet 42 into the chamber 14. The generator 35 is then energised typically at about 6 kW. Microwaves penetrate about 100 mm into the wall 12, causing water to vaporize, and this water vapor flows through pores in the concrete into the chamber 14 to be carried along with the air flow to the water trap 30. At higher powers, for example 20 kW, the concrete is cracked and/or spalled, so that dust is also generated, but this is caught by the HEPA filter 28. The wire mesh 18 minimizes leakage of microwave energy from the concrete. At intervals during operation the HEPA filter 28 is cleaned by backpulsing, and the collected dust may be removed from the filter unit 28; at intervals it may also be necessary to recharge the water trap 30 with fresh pellets of zeolite.

If the concrete wall 12 had at an earlier stage been contaminated with tritium gas (e.g. HT) or with tritiated water (e.g. HTO), then the tritium atoms typically take the place of ordinary hydrogen-atoms in unbound water in the concrete, or pore water, or water of hydration bound to the concrete, or hydroxyl groups within the concrete itself. With prolonged heating all the different forms can be removed, though the less bound forms are removed more readily. The apparatus 10 consequently enables substantially all the tritium in the surface region of the concrete (where the bulk of the tritium atoms do in fact occur) to be removed and to be trapped in the zeolite pellets in the water trap 30. This can therefore significantly lower the radioactivity of the concrete, so enabling it to be disposed of more cheaply.

I claim:

1. A method of removing tritium from a porous solid object comprising concrete, the method comprising irradiating a surface of the concrete object with microwaves of sufficient intensity to vaporize substantially all the water within about 100 mm of the surface, removing water vapor from the surface through an extraction duct incorporating a dust trap, and trapping any water vapor flowing through the duct, the irradiation intensity being such as to vaporize water and to enable it to be removed while not causing cracking or shattering of the concrete.

2. A method as claimed in claim 1 wherein the microwave power is at least 6 kW.

3. A method as claimed in claim 1 wherein the method also includes causing air to flow over the surface of the object and out of the extraction duct during the irradiation.

4. A method as claimed in claim 3 wherein the microwaves are incident on the surface via a waveguide, and at least part of the said flow of air is arranged to flow along at least part of the waveguide, and wherein the open end of the extraction duct, which in use is adjacent to the surface of the object, is surrounded by means to absorb microwaves.

5. A method as claimed in claim 1 wherein the water vapor is trapped in a molecular sieve trap.

* * * * *